United States Patent [19]

Aldrich

[11] Patent Number: 4,577,864

[45] Date of Patent: Mar. 25, 1986

[54] BATTING AID

[76] Inventor: Michael A. Aldrich, Cool, Calif.

[21] Appl. No.: 741,967

[22] Filed: Jun. 6, 1985

[51] Int. Cl.[4] ..... A63B 69/40

[52] U.S. Cl. ..... 273/26 E; 273/58 C

[58] Field of Search ..... 273/26 E, 184 B, 185 C, 273/208, 58 C, 58 B, 58 D, 413, 414

[56] References Cited

U.S. PATENT DOCUMENTS

| | | | |
|---|---|---|---|
| 2,823,038 | 2/1958 | White | 273/26 E |
| 3,637,209 | 1/1972 | Raut | 273/26 E |
| 3,907,287 | 9/1975 | Fox et al. | 273/26 E |
| 4,032,145 | 6/1977 | Tami | 273/26 E |
| 4,186,921 | 2/1980 | Fox | 273/26 E |

*Primary Examiner*—Richard C. Pinkham
*Assistant Examiner*—T. Brown
*Attorney, Agent, or Firm*—Mark C. Jacobs

[57] ABSTRACT

A tethered ball rotationally mounted such that upon rotation of a handle mounted wand from which the tethered ball dangles, centrifugal motion raises the ball to a position of delivery to a batter to swing at the ball. The wand is an L-shaped spring steel rod rotatably mounted in the handle. The rod extends into, and is secured to, a braided cord to which the ball is tethered.

6 Claims, 7 Drawing Figures

BATTING AID

FIELD OF THE INVENTION

The apparatus relates to sports equipment and more particularly to a training aid to use by softball and baseball batters.

BACKGROUND OF THE INVENTION

One of the more difficult aspects of baseball and softball for children is the fact that they lack proper eye-hand coordination in order to be able to bat the ball. It is for this reason that both boys and girls in baseball and softball, learn to bat with the ball placed on a tee. A tee is a rubber tubular member mounted on a base that hold a ball. A player swings at the ball and the ball is then in play. While a tee permits a game to proceed, and allows the ball to get into the field of play, it does not permit the children to learn to judge the height and speed of a ball approaching the bat. True eye-hand coordination can only come from swinging a softball or baseball bat at a moving target. While baseball throwing machines do exist, the cost of same prohibits their use other than under controlled conditions, and for safety reasons, they can only be used under controlled conditions. Those conditions include netted areas of large expanse. These machines tend to throw the ball at the batter either very fast in the case of baseball arcades, such that only adults or teenagers at best can utilize them, and those that throw a ball slower, require fielders to go after the ball, since they are being used in open environments.

There is a need therefore for a device that will help develop eye-hand coordination of young ball players, both male and female and which can be utilized with a minimum number of people.

It is an object therefore to provide an eye-hand coordination device suitable for use by youngsters.

It is another object to provide an eye-hand coordination device for use by young ball players that requires only one person in addition to the batter.

Yet another object to provide a device that is easy to use for youngsters without adult supervision.

Still another object is to provide a ball hitting aid that does not require large physical area in which to be utilized.

These and other objects will in part be obvious and will in part appear hereinafter.

The invention accordingly comprises the apparatus possessing the features properties and the relation of components which are exemplified in the following detailed disclosure and the scope of the application of which will be indicated in the claims.

For a fuller understanding of the nature and objects of the invention, reference should be had to the following detailed description taken in connection with the accompanying drawings.

SUMMARY OF THE INVENTION

Figures 1, 2, 3, 4, 5, 6, 7:
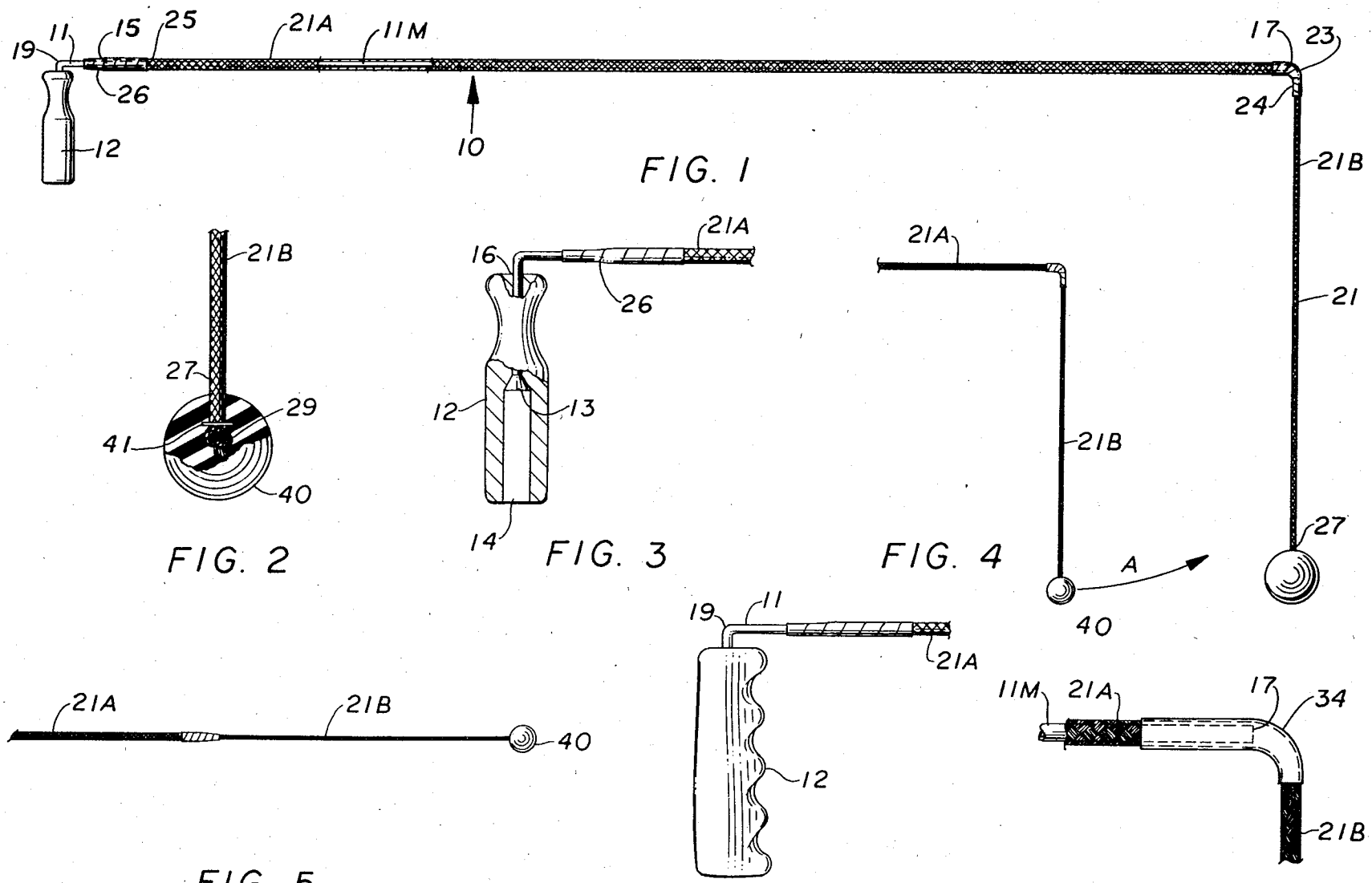
FIG. 1 is a perspective view of the device of this invention.
FIG. 2 is a close-up view of the ball and ball attachment means of this invention.
FIG. 3 is a close-up view showing a portion of this invention.
FIG. 4 is a diagrammatic view showing the tethered ball at rest prior to the application of centrifugal force.
FIG. 5 is a diagrammatic view showing the tethered ball in a delivery position for the batter after the application of centrifugal force.
FIG. 6 is an elevation view of a variant of a part of this invention.
FIG. 7 is a close-up view of a part of the invention illustrating a variant thereof.

A tethered ball attached to an elongated wand which wand is mounted for rotation about the horizontal axis on a handle which is held by the operator.

Upon rotational movement of the wand by the operator, the ball moves from a generally vertical to the wand disposition to a generally horizontal, almost axially aligned disposition with the wand, for the batter to swing at.

DESCRIPTION OF THE PREFERRED EMBODIMENT

Apparatus 10 as seen in FIG. 1 comprises a rod or extended wand 11 having a wider terminal portion 13 at the proximal end thereof. Rod 11 is bent at an approximately 90° angle at location 19 near the proximal end 13, which as is seen is disposed within handle 12. Handle 12 has an opening of a bore 14 of a first diameter, sized to receive the rod and its terminal portion 13. However the upper end of handle 12 has an opening of a narrower diameter 16, adapted only for the rod's main portion i.e. all but the terminal portion to pass through. Note, handle 12 is cutaway to facilitate the understanding of this point. Subsequent to insertion of the rod 11 through opening 16, bend 19 is made. Therefore rod 11 can be seen to be rotatable 360 degrees within handle 12. The outwardly extending main body portion of the wand 11 is designated 11M.

A braided tubular rope 21 preferably of polypropylene or nylon and consisting of 2 or 3 individual strands is opened at the near end 25 to permit insertion of portion 11 therein. Portion 11 is extended inwardly along the length of the rope approximately five feet. Adhesive tape or preferably a heat shrinkable shrink tubing wrap 26 secures rope end 25 at location 15, along the length of the rod, while adhesive tape wrap 24 receives and binds the braided end of the opened portion 21A of rope 21 at location 23 thereupon at the terminus 17 of the rod. The balance of the rope 21B is permitted to hang freely from the end of rod 11.

A ring washer 41 is placed on the rope 21 at its distal end 27, and the said end is knotted at knot 29. While such knotted end may be forcibly inserted into ball 40, the preferable means is to place the knot and end 27 within a heated mold into which a liquid rubber is added, and then permitted to set up and cure over the knot 29 thus attaching the ball to the knot. Such a ball forms the subject matter of U.S. patent application by ATEC.

The technology of molding of rubber balls is known in the art, and it is within the skill of those in the art to understand how to adapt a mold to hold the knot 29 and the washer containing end 27 therein during the molding process.

The rope 21 has two portions, the first of which the rod disposed therein, and which is designated 21A and which is longer than the second portion 21B which hangs loose beyond the end of the rod. The second portion 21B is shorter in length than the main body portion 11M of the rod 11.

The handle 12 may be of wood or metal or plastic and be tubular as shown in FIG. 1, or may include a grip as shown in FIG. 6.

In a particularly useful embodiment I found that a ½" nylon reinforced rope of approximately 100 inches in length allowed for adequate placement of the rod and for a sufficiently long dangling rope section. Preferably an easy to see color such as safety yellow or safety orange should be employed. However any other color may be employed.

A particularly suitable rod is one of spring steel about 0.207 in diameter and 5 feet long. The use of the spring steel makes for easy flexing of the apparatus in use as will be described below, and at the same time avoids the possibility of the rod snapping upon impact of the bat with the tethered ball. The wand or rod 11 may be solid or tubular.

The ball may be dimpled, smooth, or seamed according to the preference of the consumers application. The foam rubber composition should have a density such that when the ball is sized to match either a softball or baseball (hardball) or other sized balls as required, the approximate weight will be lighter for saftey reasons. The benefit of this is that upon impact of the bat with the ball, the same "feel" or response as hitting a real ball will be felt by the batter.

The use of foam presents any possibility of injury should the ball in some way impact the body of either of the operator or the batter. This however is substantially impossible due to he 21B portion being shorter than the 21A portion.

The handle 12 of wood or metal or plastic, should be about 4" to 6" long and may have a grip on it to insure ease of grasping by even youngsters of at least 8 years of age as shown in FIG. 6.

To use the apparatus, two persons are needed, the operator and the hitter (batter). The operator takes the handle 12 in one or both hands and holds it in front of him with the elbow(s) straight or bent such that the handle is in a generally vertical above the head disposition. By waving the handle i.e. gyrating it in a slight circular orbit, the rod 11 will be free to rotate 360 degrees to the front, back and sides of the operator. The ball 40 on rope segment 21B which in the relaxed position of the rod, i.e. no or minimal movement hangs downwardly as seen in FIG. 4, will by centrifugal motion assume a position away from the vertical as shown by the arrow A designating movement away from the vertical toward the horizontal or even through the horizontal, depending on the attitude of the handle 12. The batter watches the ball 40 at the end of rope segment 21B as it approaches during its rotational orbit, and swings his or her bat to hit the ball as it crosses the hypothetical home plate. When the batter contacts the ball, the ball will be subjected to a shock from the impact, but the shock is generally dissipated along the rope segment 21B and the rod 11 so as to have minimal effect on the operator.

On the other hand since the rope segment 21B is sized to be shorter than the rod 11, even if due to what would be equivalent of a foul ball, the ball is directed toward the operator, there is no way the operator can be injured. This is because the rope segment 21B is short enough not to be able to hit the operator on either the face or hands. Even when rod 11 flexes to its maximum, and the ball's angle of approach parallels the rod, the tethered ball still cannot hit the operator.

It is seen that I have provided an apparatus that allows children of all ages to improve their eye hand coordination for batting or to assist in the development of an individual's motor muscles. The ball is readily available to go over home plate for impact with the batter's bat. There is also no need to chase hits as the ball remains tethered to the device.

As a child or adult improves his eye hand coordination by getting more and more "hits" the operator can speed up the "pitch" by spinning the apparatus in his hand faster thereby increasing the speed of the rotational movement of the ball.

With skilled short batters, the degree of difficulty can be increased by having the operator be a tall person, such that the rotational orbit of the ball is angular rather than horizontal thereby making the ball harder to hit.

While the instant apparatus has been designed for the safety of both the operator and the hitter, still observers should stand 8–15 feet away in case the batter knocks the device out of the grasp of the operator as by hitting the dangling rope instead of the ball such that the apparatus goes flying off into space.

In general however this is a very safe piece of equipment, as the chances of it being removed from the grasp of the operator, flying off and hitting anyone else is indeed remote.

FIG. 7, is a close-up view showing the view of shrink tubing 34 in place of wrap 24 at distal end of main portion 11M, i.e. adjacent rod end 17.

I claim:

1. An apparatus for improving the eye hand coordination of a softball or baseball batter comprising:

a handle, adapted to be held generally vertically, a flexible rod mounted in said handle for rotational movement, about a generally vertical axis, said rod including a terminal portion mounted in said handle, and a main body portion extending 90° from said terminal portion, and having a distal end in the main body portion, a rope having a first portion and a second portion, the first portion being longer than the second portion, and the second portion being shorter than the main body portion of the rod, said main portion of the rod being disposed within said rope's first portion, and a ball simulating a baseball or softball attached to the end of the second portion of the rope dangling from the distal end of the rod, whereby upon swirling of the handle vertically the flexible rod rotates in a generally horizontal plane, and the dangling portion of rope with the ball attached moves by centrifugal force outwardly toward a horizontal disposition for a batter to hit the ball.

2. In the device of claim 1 wherein the first rope portion into which the main body of the flexible rod is disposed, is secured to said rod by an adhesive tape wrap.

3. In the device of claim 1 wherein the location on the rope where the rod inserted therein terminates, is tape wrapped.

4. In the device of claim 1 wherein the handle includes a grip.

5. In the device of claim 1 wherein the handle is wood, and the rope is taped at the location therein, corresponding to the distal end of the rod.

6. In the device of claim 1 wherein the first rope portion into which the main body of the flexible rod is disposed, is secured to said rod by a heat shrinkable shrink tubing.

* * * * *